US009073182B2

(12) United States Patent
Liou

(10) Patent No.: US 9,073,182 B2
(45) Date of Patent: Jul. 7, 2015

(54) SCREWING TOOL

(71) Applicant: Mou-Tang Liou, Taichung (TW)

(72) Inventor: Mou-Tang Liou, Taichung (TW)

( * ) Notice: Subject to any disclaimer, the term of this patent is extended or adjusted under 35 U.S.C. 154(b) by 436 days.

(21) Appl. No.: 13/664,487

(22) Filed: Oct. 31, 2012

(65) Prior Publication Data

US 2014/0116204 A1 May 1, 2014

(51) Int. Cl.

| | |
|---|---|
| ***B25B 13/00*** | (2006.01) |
| ***B25B 19/00*** | (2006.01) |
| ***B25D 16/00*** | (2006.01) |
| ***B25B 15/02*** | (2006.01) |
| *B25B 13/46* | (2006.01) |
| *B25B 13/48* | (2006.01) |

(52) U.S. Cl.

CPC ..... *B25B 19/00* (2013.01); *B25D 16/006* (2013.01); *B25B 13/46* (2013.01); *B25D 2216/0038* (2013.01); *B25B 13/48* (2013.01); *B25B 13/461* (2013.01); *B25D 16/00* (2013.01); *B25D 2216/0015* (2013.01); *B25B 13/462* (2013.01); *B25B 13/463* (2013.01); *B25B 15/02* (2013.01)

(58) Field of Classification Search

CPC ..... B25D 16/006; B25D 2216/0023; B25D 16/00; B25D 2216/0038; B25D 2216/0015; B25B 13/462; B25B 13/46; B25B 13/463; B25B 13/48; B25B 13/461

USPC ..... 81/58

See application file for complete search history.

(56) References Cited

U.S. PATENT DOCUMENTS

| | | | | |
|---|---|---|---|---|
| 3,680,642 | A * | 8/1972 | Kirn et al. | 173/13 |
| 4,236,588 | A * | 12/1980 | Moldan et al. | 173/48 |
| 4,696,208 | A * | 9/1987 | Lay | 81/58 |
| 4,763,733 | A * | 8/1988 | Neumaier | 173/48 |
| 5,346,023 | A * | 9/1994 | Takagi et al. | 173/178 |
| 6,176,321 | B1 * | 1/2001 | Arakawa et al. | 173/48 |
| 6,192,996 | B1 * | 2/2001 | Sakaguchi et al. | 173/48 |
| 6,712,156 | B2 * | 3/2004 | Funfer | 173/48 |
| 6,976,545 | B2 * | 12/2005 | Greitmann | 173/104 |
| 7,225,884 | B2 * | 6/2007 | Aeberhard | 173/93.5 |
| 7,497,272 | B2 * | 3/2009 | Strasser et al. | 173/48 |
| 8,122,971 | B2 * | 2/2012 | Whitmire et al. | 173/48 |
| 8,650,988 | B2 * | 2/2014 | Yen | 81/9.41 |

FOREIGN PATENT DOCUMENTS

| | | |
|---|---|---|
| TW | M426473 | 4/2012 |

* cited by examiner

*Primary Examiner* — Monica Carter
*Assistant Examiner* — Danny Hong
(74) *Attorney, Agent, or Firm* — Alan D. Kamrath; Kamrath IP Lawfirm, P.A.

(57) ABSTRACT

A screwing tool includes an engaging member adapted to be gripped as a handle including a first inserting member. A biasing member is received within the engaging member. A driving member includes a driving head and a guiding groove at two different ends. The guiding groove receives the first inserting member. The first inserting member interconnects the engaging member and the driving member. The biasing member is disposed between the driving member and the engaging member. A control ring receives the driving member and is selectively movable between a first position disposed at a first relative position with respect to the engaging member and in which the screwing tool becomes an impact screwdriver, and a second position disposed at a second relative position with respect to the engaging member and in which the screwing tool becomes a regular screwdriver.

18 Claims, 14 Drawing Sheets

SCREWING TOOL

BACKGROUND OF THE INVENTION

1. Field of the Invention

The present invention relates to a screwing tool and, particularly to a screwing tool capable of becoming an impact screwdriver and a regular screwdriver selectively.

2. Description of the Related Art

TW Patent No. M426,473 teaches an impact screwdriver. This impact screwdriver can be used to break bolts or screws free when they are stuck tight or for tightening as well. Generally, a user in a process of removing stuck bolts or screws uses such impact screwdriver until the stuck bolts or screws are loosened enough to use a faster tool, such as a regular screwdriver, and uses a faster tool to tighten bolts or screws and then uses such impact screwdriver when it becomes difficult to tighten the bolts or screws. However, it is not convenient.

The present invention is, therefore, intended to obviate or at least alleviate the problems encountered in the prior art.

SUMMARY OF THE INVENTION

According to the present invention, a screwing tool includes an engaging member adapted to be gripped as a handle including a first inserting member. A biasing member is received within the engaging member. A driving member includes a driving head and a guiding groove at two different ends. The guiding groove receives the first inserting member. The first inserting member interconnects the engaging member and the driving member. The biasing member is disposed between the driving member and the engaging member. A control ring receives the driving member and is selectively movable between a first position disposed at a first relative position with respect to the engaging member and in which the screwing tool becomes an impact screwdriver, and a second position disposed at a second relative position with respect to the engaging member and in which the screwing tool becomes a regular screwdriver.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a screwing tool capable of becoming an impact screwdriver and a regular screwdriver selectively.

It is also an object of the present invention to provide a screwing tool that has a simple structure.

Other objects, advantages, and new features of the present invention will become apparent from the following detailed description of the invention when considered in conjunction with the accompanied drawings.

DETAILED DESCRIPTION OF THE INVENTION

Figure 1:
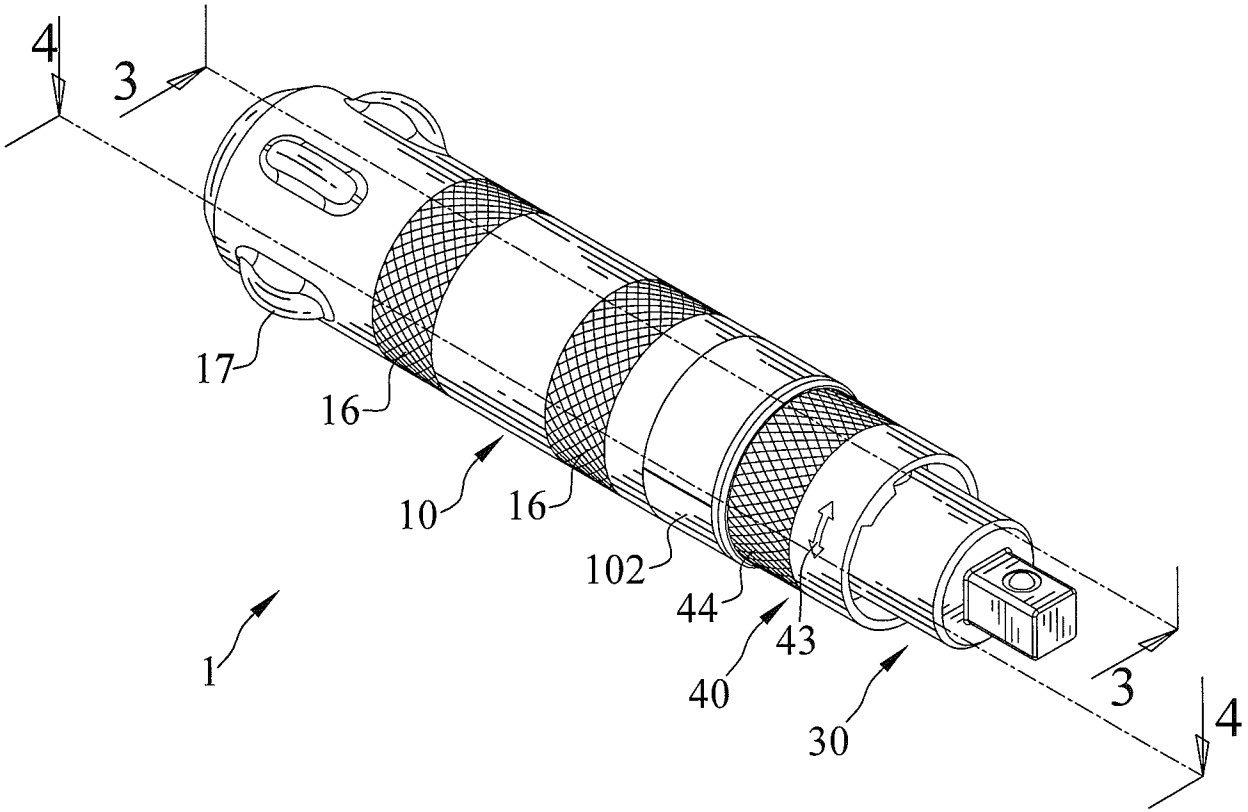
FIG. 1 is a perspective view of a screwing tool in accordance with a first embodiment of the present invention.
Figure 2:
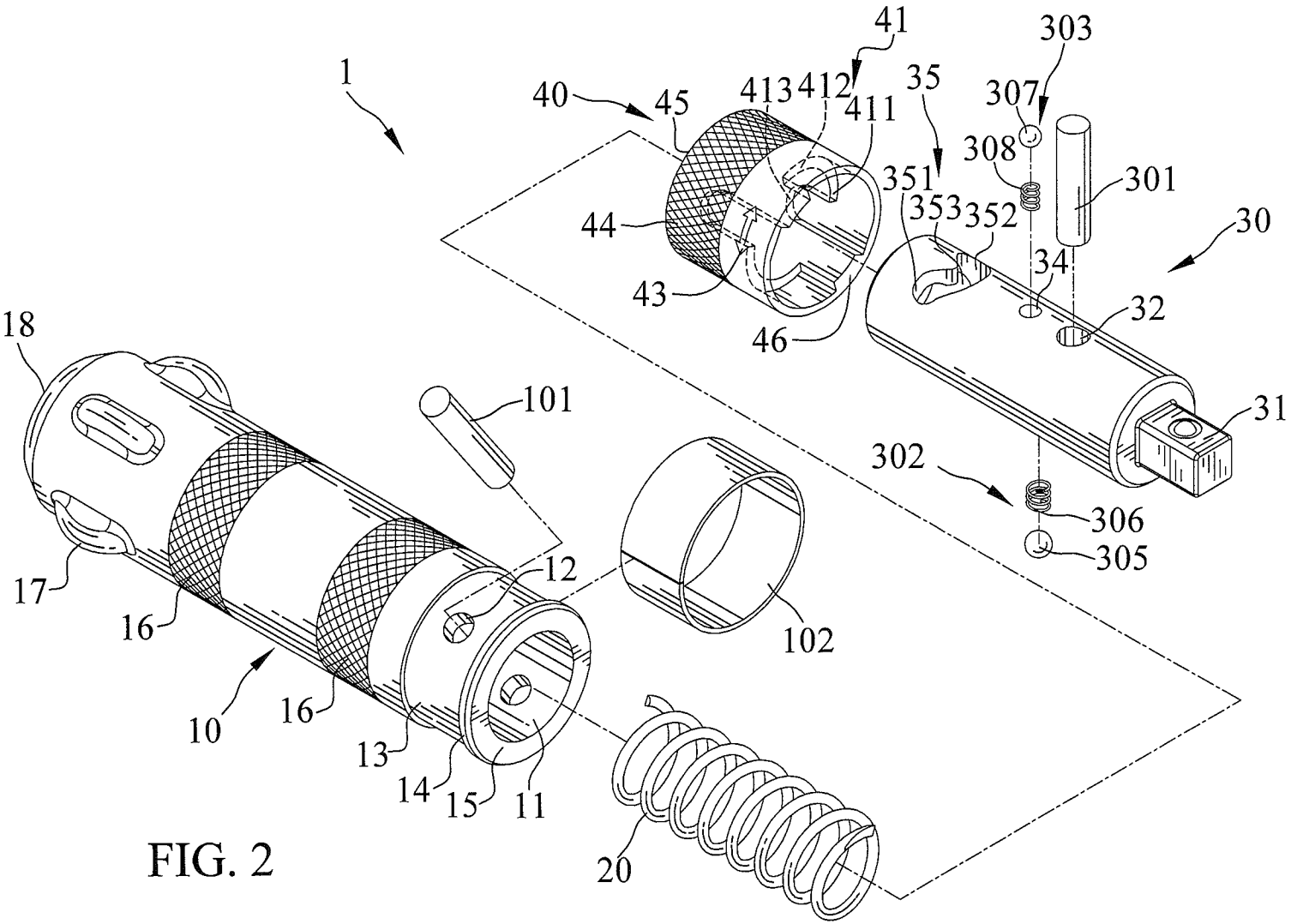
FIG. 2 is an exploded view of the screwing tool of FIG. 1.
Figure 3:
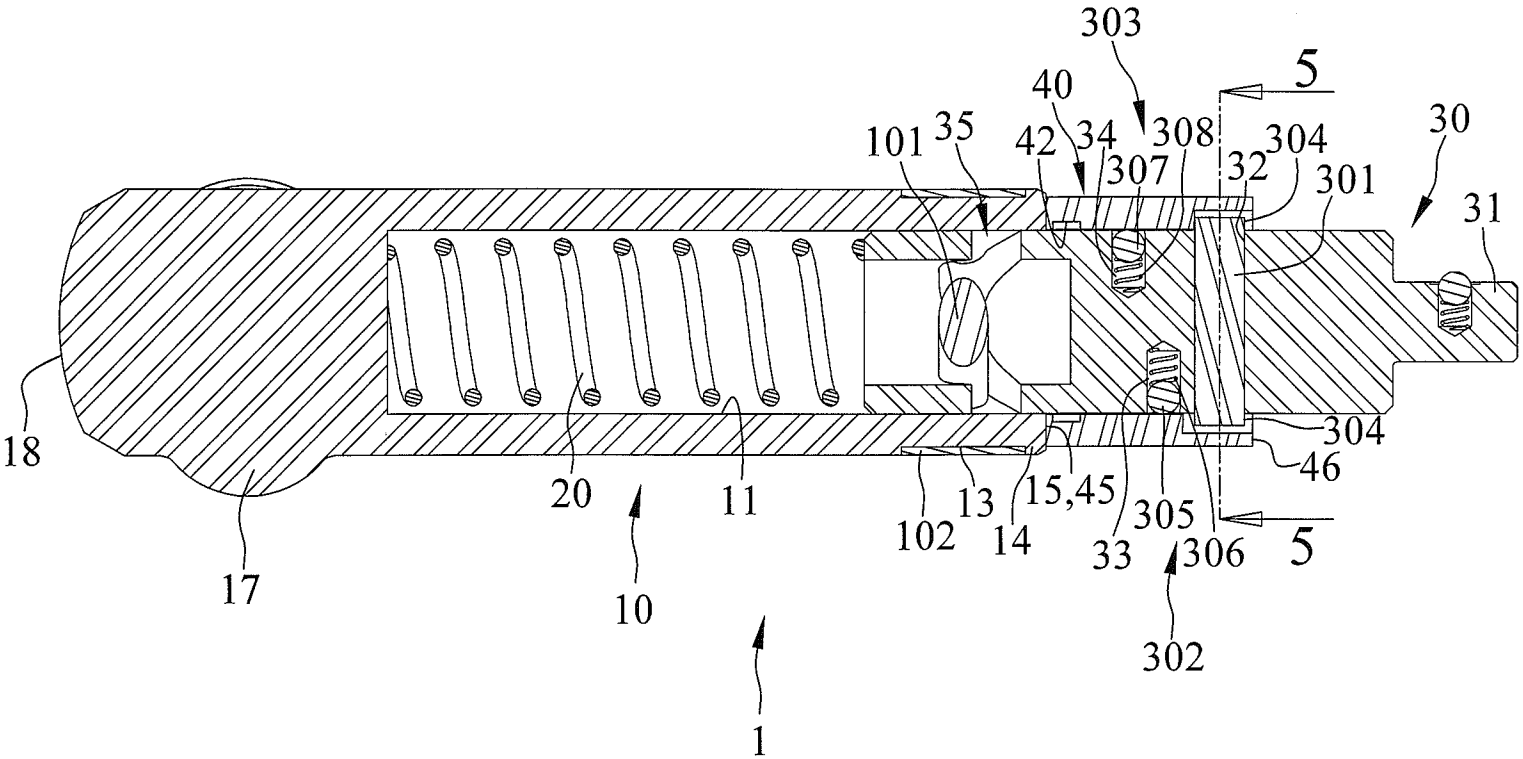
FIG. 3 is a cross-sectional view taken along line 3-3 of FIG. 1.
Figure 4:
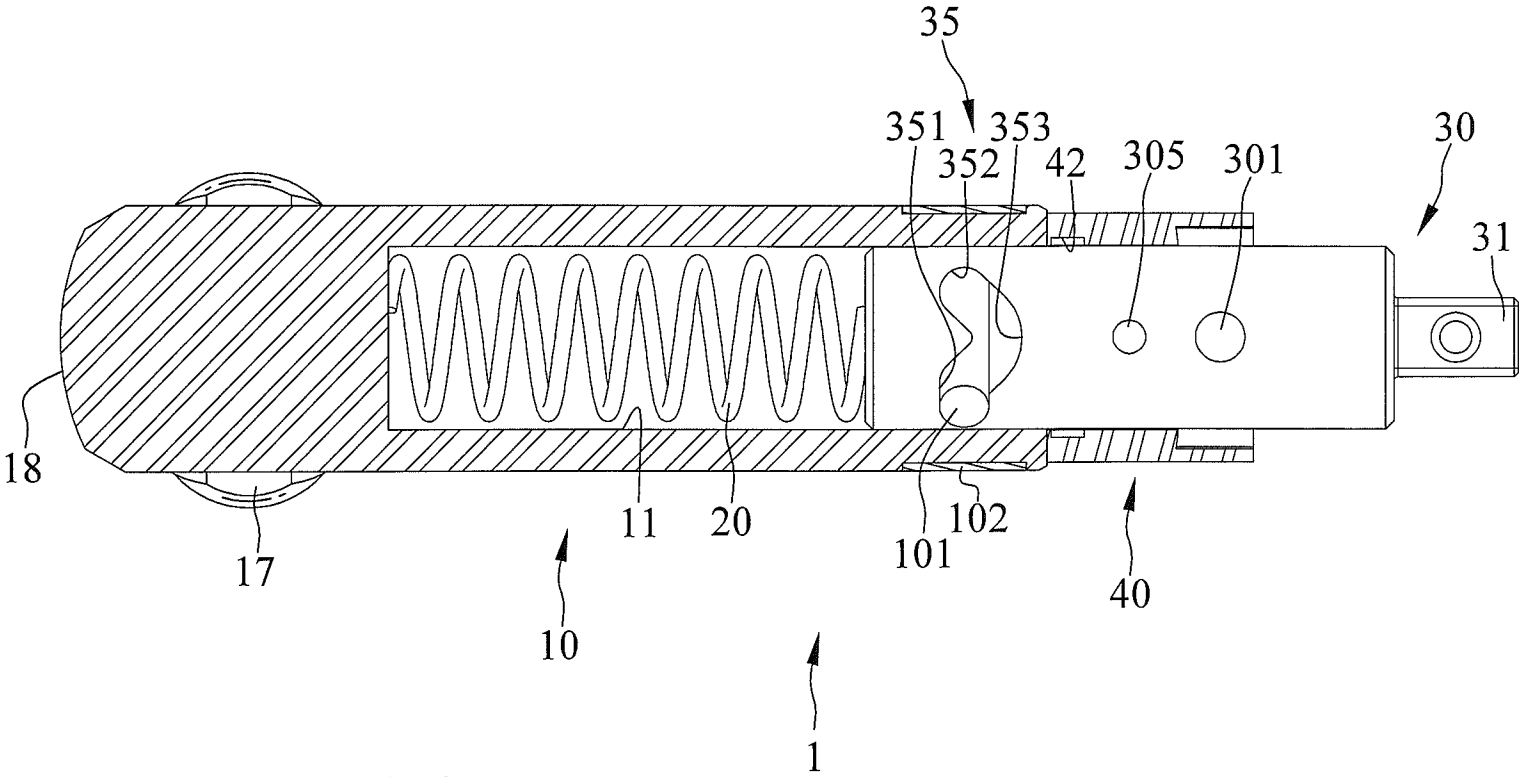
FIG. 4 is a cross-sectional view taken along line 4-4 of FIG. 1.
Figure 6:
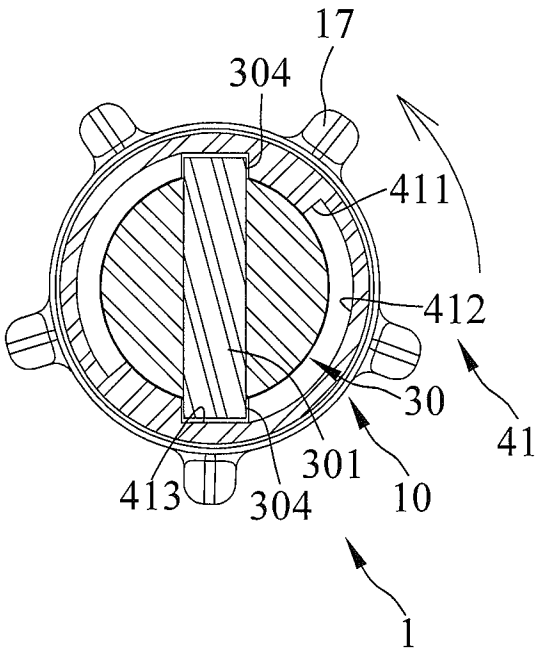
FIG. 6 is a cross-sectional view showing control ring and driving member of the screwing tool rotated relative to each other to a position different from that shown in FIG. 5.
Figure 5:
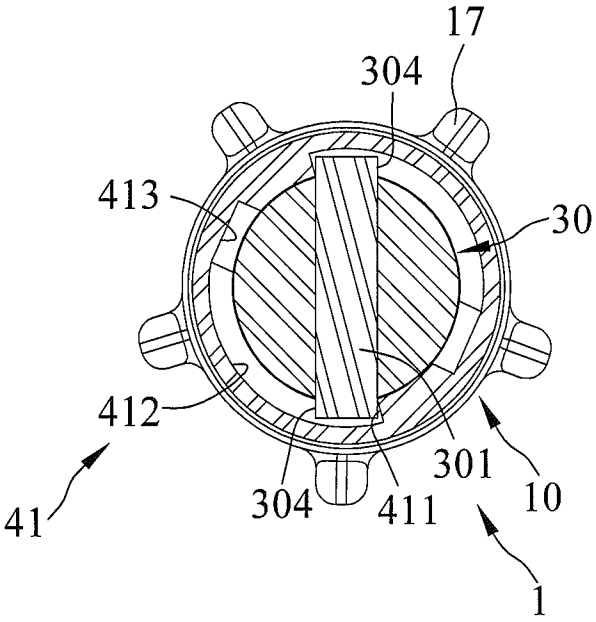
FIG. 5 is a cross-sectional view taken along line 5-5 of FIG. 3.
Figure 7:
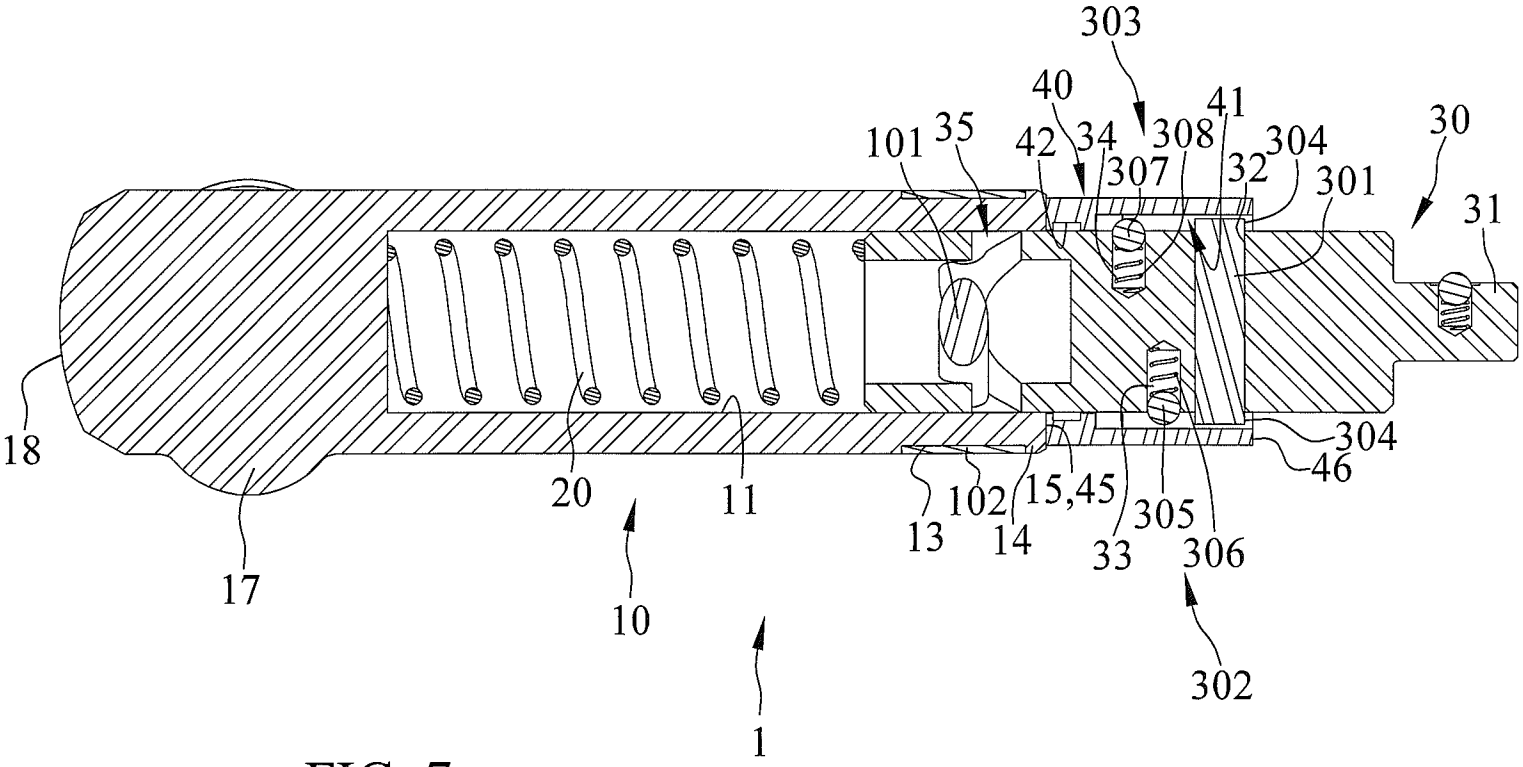
FIG. 7 is a cross-sectional view showing the screwing tool including the control ring and the driving member rotated relative to each other to a position different from that shown in FIG. 3.
Figure 8:
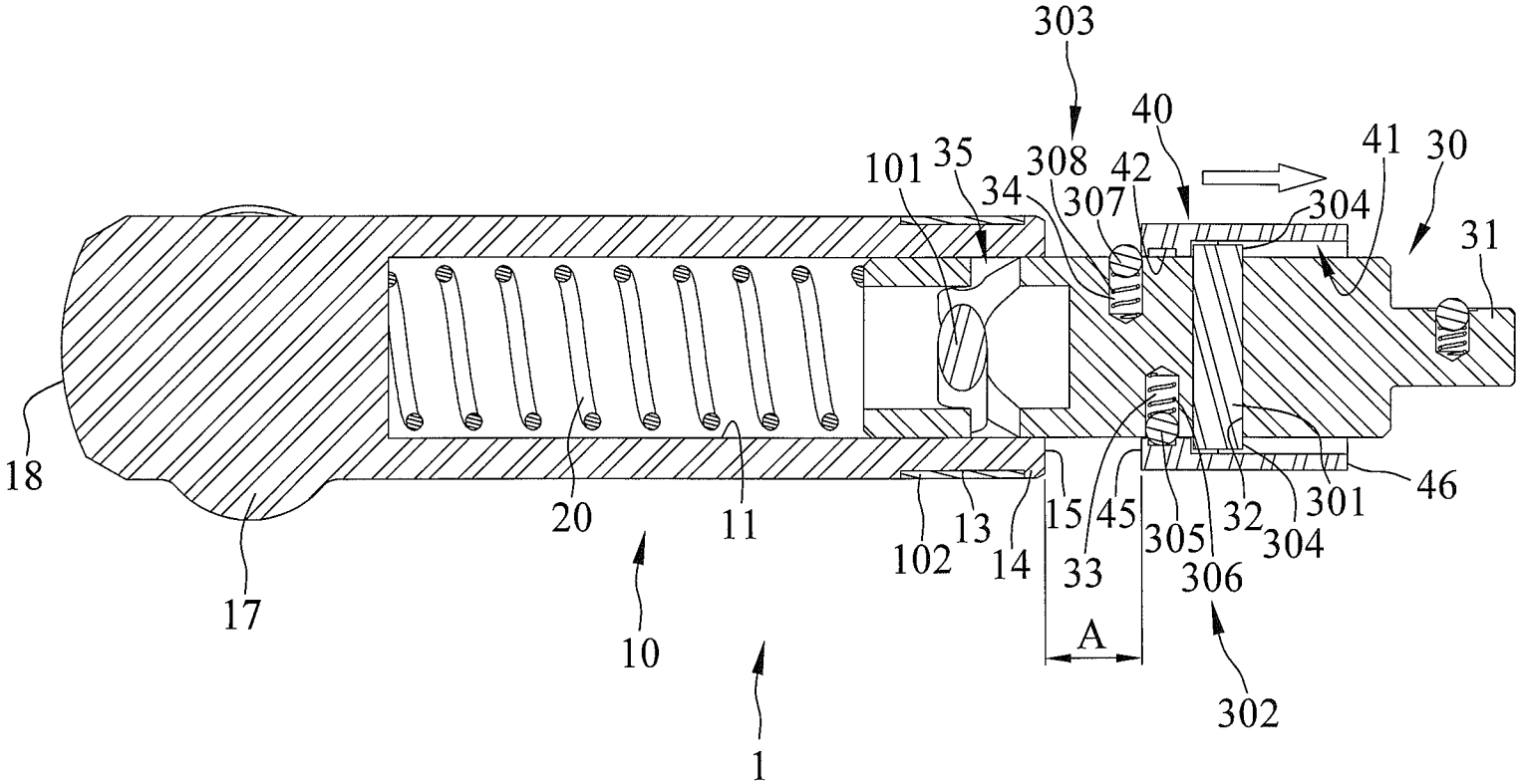
FIG. 8 is a cross-sectional view showing the screwing tool including the control ring and the driving member axially moved relative to each other to a position different from that shown in FIG. 7.
Figure 9:
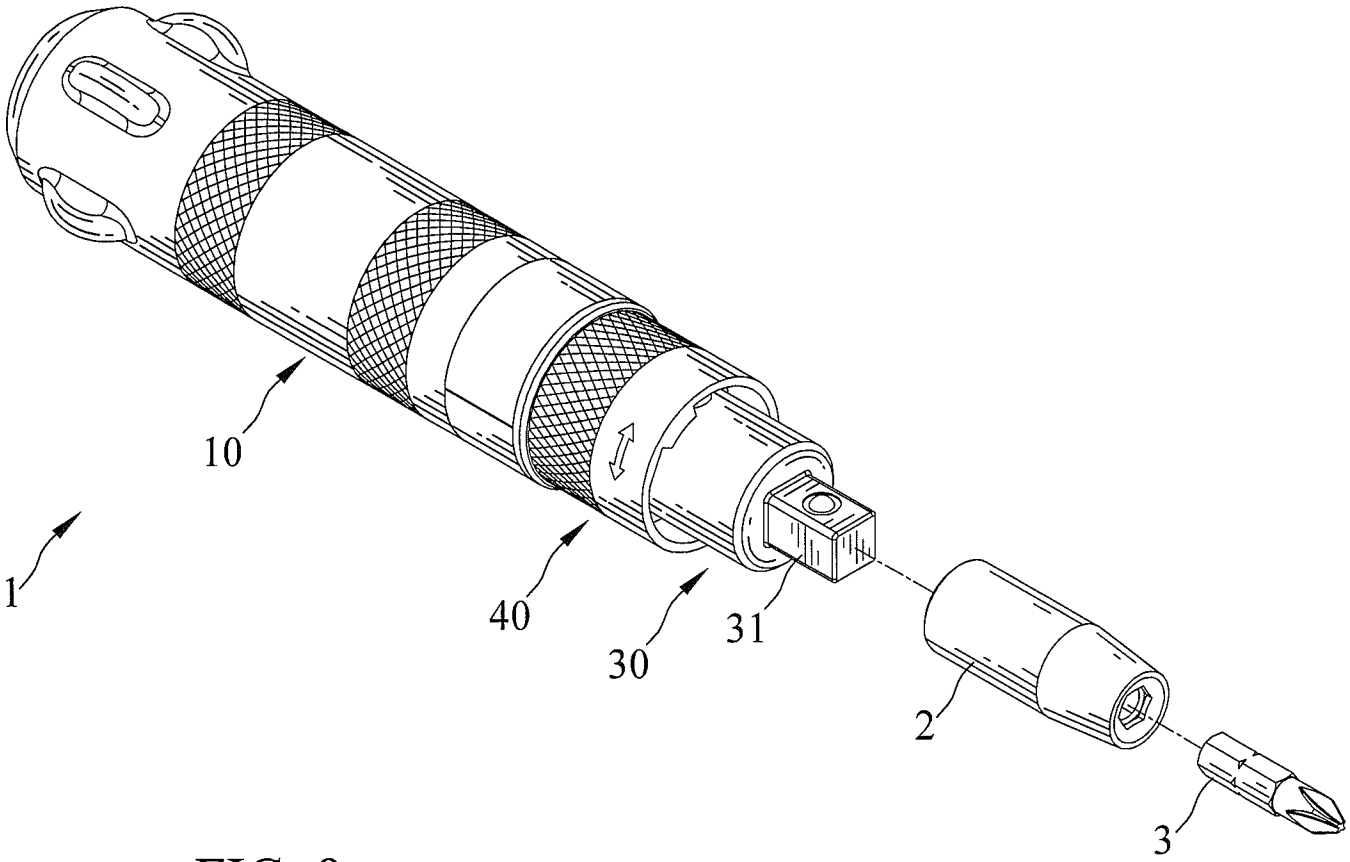
FIG. 9 is a perspective view showing the screwing tool and a bit holder and a bit, with the screwing tool engagable with the bit holder, with the bit holder engagable with a bit.
Figure 10:
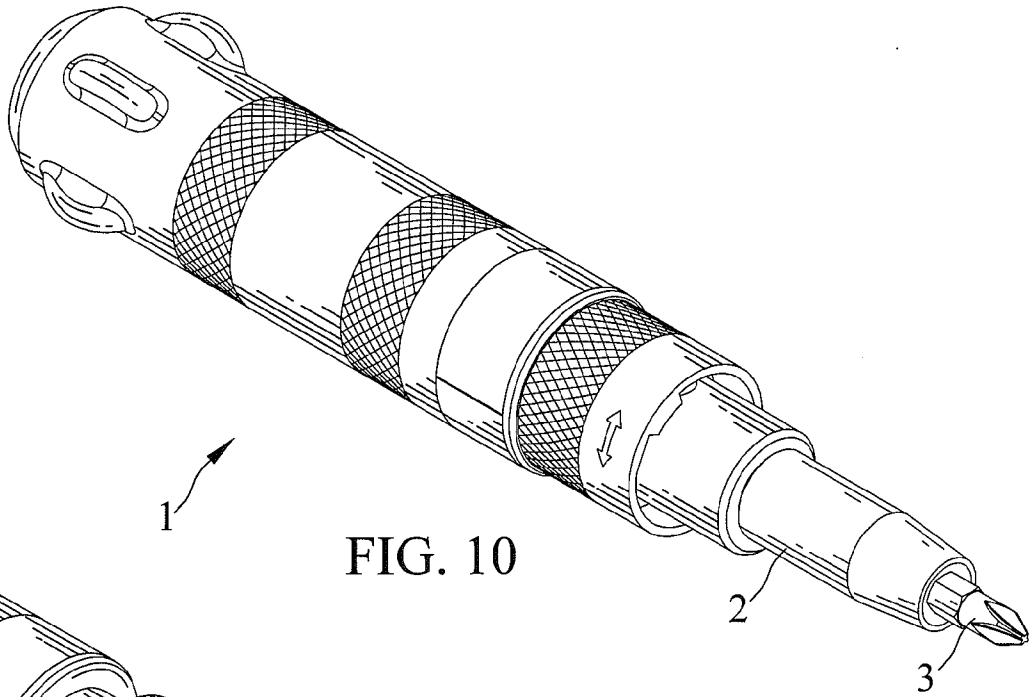
FIG. 10 is a perspective view showing the screwing tool in a first operation mode capable of becoming a regular screwdriver.
Figure 11:
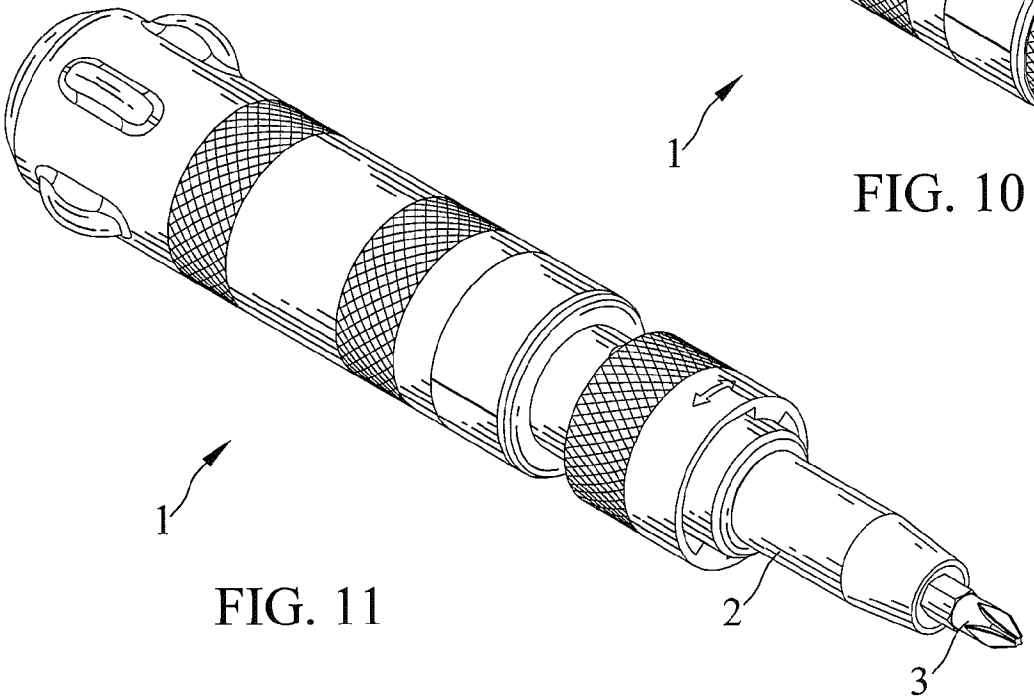
FIG. 11 is a perspective view showing the screwing tool in a second operation mode capable of becoming an impact screwdriver.
Figure 12:
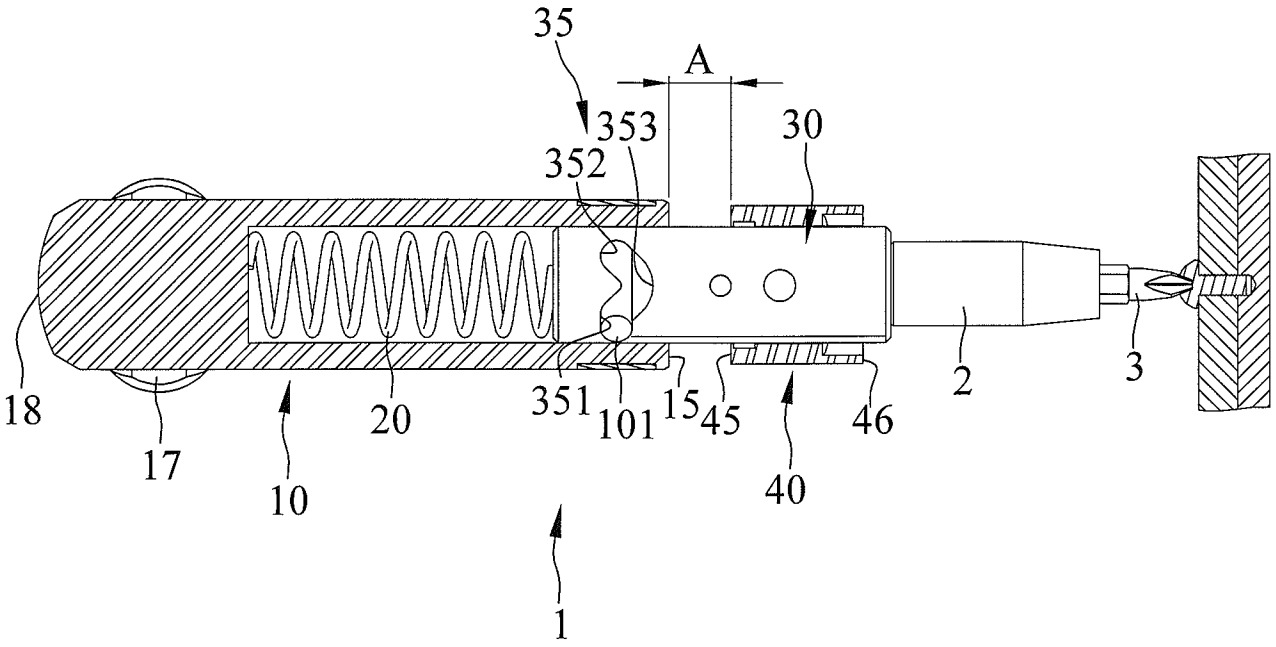
FIG. 12 is a cross-sectional view of FIG. 11 and shows the screwing tool, the bit holder and the bit in use for driving a fastener, with the screwing tool in the second operation mode.
Figure 13:
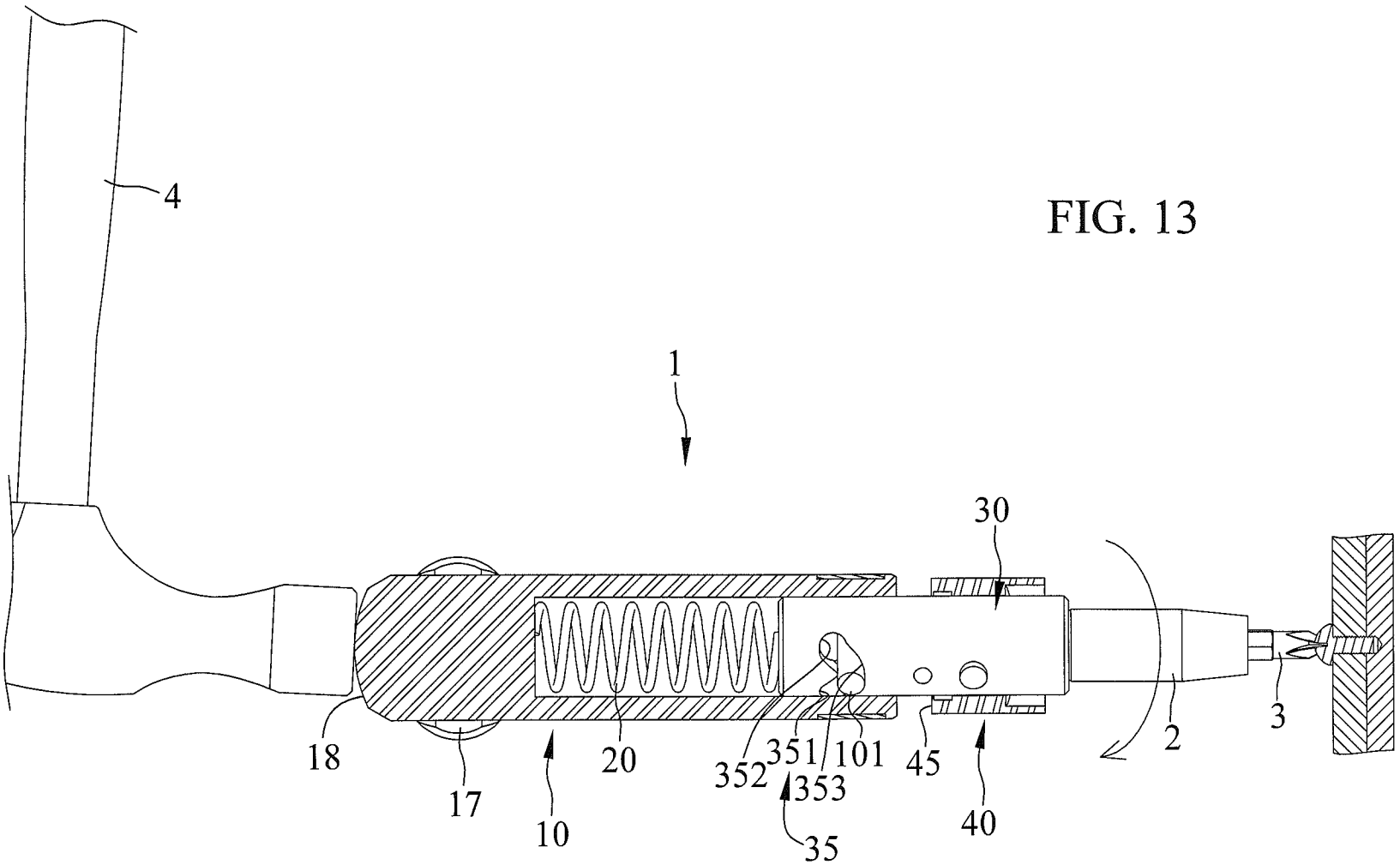
FIG. 13 is a cross-sectional view showing the fastener rotated by the screwing tool, the bit holder and the bit after the screwing tool whacked by a hammer, with the screwing tool in the second operation mode.
Figure 14:
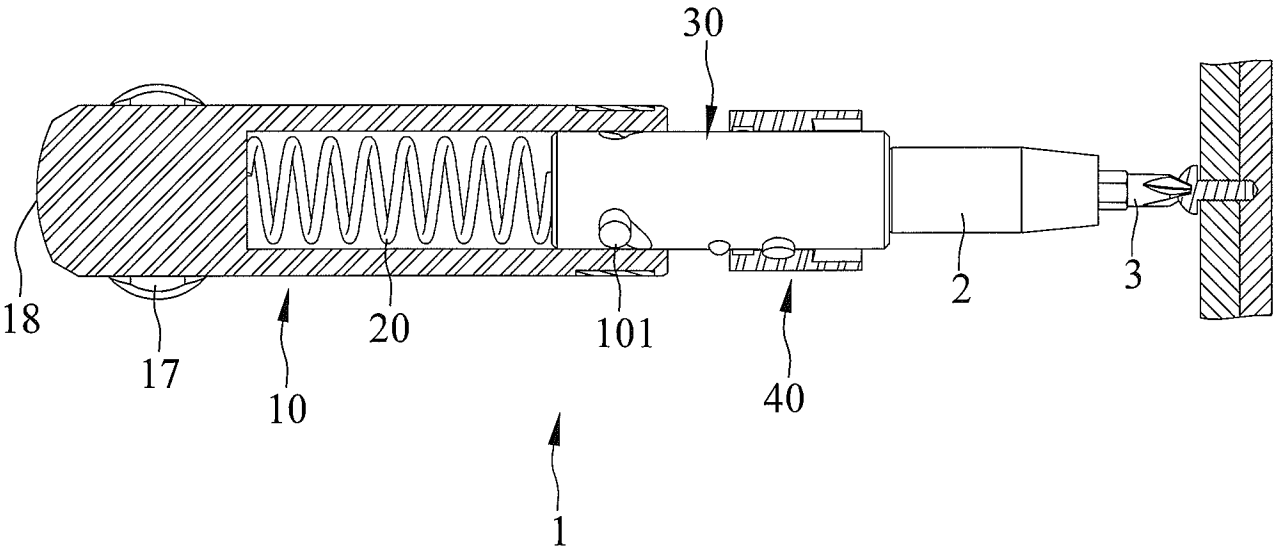
FIG. 14 is a continued cross-sectional view of FIG. 13 and shows the screwing tool, the bit holder and the bit rotated to a position different from that shown in FIG. 13 and the fastener loosened slightly.
Figure 15:
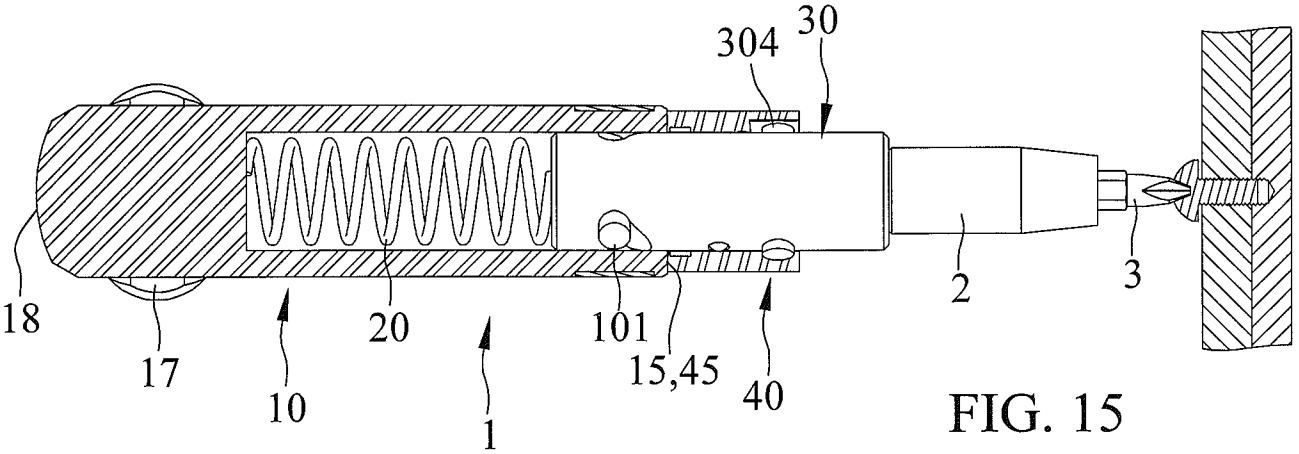
FIG. 15 is a cross-sectional view showing the screwing tool, the bit holder and the bit in use for driving the fastener, with the screwing tool in the first operation mode.
Figure 16:
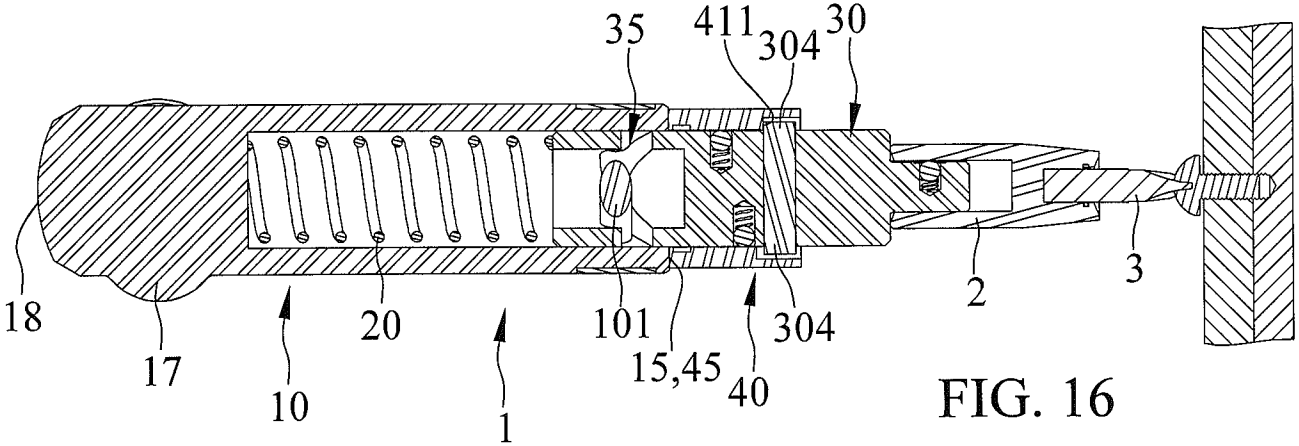
FIG. 16 is another cross-sectional view showing the screwing tool, the bit holder and the bit in use for driving the fastener, with the screwing tool in the first operation mode.
Figure 17:
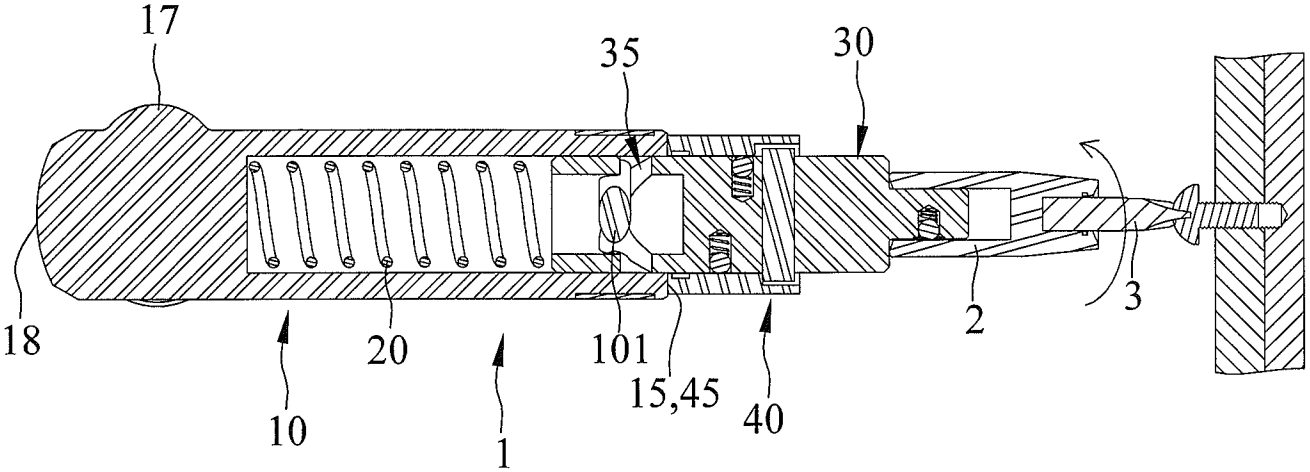
FIG. 17 is a continued cross-sectional view of FIG. 16 and shows the screwing tool, the bit holder and the bit rotated to a position different from that shown in FIG. 16 and the fastener further loosened.

FIGS. 1-17 show a screwing tool 1 in accordance with the present invention. The screwing tool 1 includes an engaging member 10, a biasing member 20, a driving member 30, and a control ring 40.

The engaging member 10 is adapted to be gripped as a handle. The engaging member 10 includes a first inserting member 101. The engaging member 10 includes an outer periphery thereof including a recessed section 13 inset, a first aperture 12 extended in the recessed section 13, and a flange 14 protruded outwards. The first aperture 12 is extended diametrically and through the recessed section 13. The recessed section 13 is extended annularly. The first inserting member 101 is received in the first aperture 12. The engaging member 10 includes an annular member 102 sleeved on the recessed section 13 and restraining the first inserting member 101. The flange 14 prevents the annular member 102 disengaged from the engaging member 10.

The engaging member 10 includes the outer periphery thereof including at least one anti-slip area 16 preventing a user to lose a firm grip on the engaging member 10. The engaging member 10 also includes the outer periphery thereof including a plurality of humps 17 exposed therefrom and disposed one after another circumferentially.

The biasing member 20 is received within a chamber 11 of the engaging member 10. The biasing member 20 is disposed between the driving member 30 and the engaging member 10.

The driving member 30 includes a driving head 31 and a guiding groove 35 at two different ends. The driving head 31 can engage with a bit holder 2, and a bit 3 can engage in the bit holder 2. The guiding groove 35 is extended radially through the driving member 30. The guiding groove 35 receives the first inserting member 101 and which interconnects the engaging member 10 and the driving member 30. The guiding groove 35 is extended annularly and V-shapedly and includes two terminal ends thereof defining first and second stop ends 351 and 352 and a turning corner 353 at a junction of two groove sections of the V-shaped guiding groove 35. The driving member 30 includes first and second receptacles 33 and 34 defined therein and extended radially. The first receptacle 33 includes a retaining device 302 received therein. The second receptacle 34 includes a detent device 303 received therein. The retaining device 302 includes a locking member 305 and a first biasing element 306 biasing the locking member 305 to engage with the control ring 40. The detent device 303 includes a stopping member 307 and second biasing element 308 biasing the stopping member 307 to engage with the control ring 40. Each of the locking and stopping members 305 and 307 is of spherical shape. The first and second biasing elements 306 and 308 are springs. The first receptacle 33 is closer to the second aperture 32 than the second receptacle 34. The first and second receptacles 33 and 34 extend respectively in opposite directions to the outer periphery of the driving member 30. The driving member 30 includes an outer periphery thereof including at least one protrusion 304 exposed therefrom. The at least one protrusion 304 is disposed between the driving head 31 and the guiding groove 35. The driving member 30 includes a second inserting member 301 disposed therein. The second inserting member 301 includes an end thereof defining the at least one protrusion 304. The driving member 30 includes the outer periphery thereof including a second aperture 32 extended therethrough and diametrically, and the second inserting member 301 is received in the second aperture 32.

The control ring 40 receives the driving member 30 and is selectively movable between a first position disposed at a first relative position with respect to the engaging member 10 and in which the screwing tool 1 becomes an impact screwdriver, and a second position disposed at a second relative position with respect to the engaging member 10 and in which the screwing tool 1 becomes a regular screwdriver. The control ring 40 is rotatably moved between the first and second positions. The control ring 40 moved to the first position is spaced from the engaging member 10 with a gap A. The control ring 40 moved to the second position is in contact with the engaging member 10 with the gap A eliminated. The engaging member 10 includes an end thereof including a first engaging edge 15, and the control ring 40 includes an end thereof including a second engaging edge 45 spaced from the first engaging edge 15 with the gap A when the control ring 40 is moved to the first position and abutted against the first engaging edge 15 when the control ring 40 is moved to the second position, respectively. The engaging member 10 and the driving member 30 are movably engaged with each other and that when the control ring 40 is moved to the first position moving the engaging member 10 axially makes the driving member 30 rotate with respect to the engaging member 10 and that when the control ring 40 is moved to the second position rotating the engaging member 10 makes the driving member 30 rotate in synchronization. The plurality of humps 17 can efficiently prevent a user to lose a grip on the engaging member 10 when the screwing tool 1 is whacked by a hammer 4. The engaging member 10 includes an end thereof defining an impact surface 18 that the hammer 4 whacks when the screwing tool 1 becomes the impact screwdriver.

The first inserting member 101 is movably engaged in the guiding groove 35 and that the driving member 30 is rotated when the engaging member 10 is moved axially, with the control ring 40 moved to the first position. The first inserting member 101 is rest on and abutted against either the first or second stop ends 351 and 352 when the control ring 40 is moved to the second position. The control ring 40 includes an inner periphery thereof including first and second sections. The first and second sections have different internal diameters. The control ring 40 includes the inner periphery including the first section having an internal diameter smaller than that of the second section. The second section defines a recess 42. The retaining device 302 is enclosed in the second section of the inner periphery of the control ring 40 and the detent device 303 is exposed outside and abutting against an end of the control ring 40 respectively when the control ring 40 is moved to the first position. The stopping member 307 is partially exposed outside an opening of the second receptacle 34 when the control ring 40 is moved to the first position. The retaining and detent devices 302 and 303 are enclosed in the first section of the inner periphery of the control ring 40 when the control ring 40 is moved to the second position. The control ring 40 defines at least one locking section 41. The at least one protrusion 304 corresponds to the at least one locking section 41 and is movable to a position thereof preventing relative rotation the control ring 40 with respect to the driving member 30. The at least one locking section 41 includes a stop edge 411 and first and second channels 412 and 413. The first channel 412 is extended from the stop edge 411. The second channel 413 is extended from the first channel 412. The first channel 412 is extended annularly. The second channel 413 is extended axially. The at least one protrusion 304 is movable in the first channel 412 to either the stop edge 411 or the second channel 413. The at least one protrusion 304 is abutted against the stop edge 411 when the control ring 40 is moved to the first position. The at least one protrusion 304 is received in the second channel 413 when the control ring 40 is moved to the second position. The control ring 40 includes an outer periphery thereof including indicia 43 and an anti-slip pattern 44. The indicia 43 indicate directions that the control ring 40 is adapted to be operated. The anti-slip pattern 44 prevents a user to lose a firm grip on the control ring 40. The control ring 40 includes an end thereof defining a terminal edge 46. The second channel 413 has two opposite ends defining first and second ends. The first end connected to the first channel 412. The second end of the second channel 413 is spaced from the terminal edge 46 at a greater distance than the stop edge 411. The stop edge 411 is extended parallel to the terminal end 46.

While the specific embodiments have been illustrated and described, numerous modifications come to mind without significantly departing from the spirit of invention, and the scope of invention is only limited by the scope of accompanying claims.

What is claimed is:

1. A screwing tool comprising:

an engaging member adapted to be gripped as a handle including a first inserting member; a biasing member received within a chamber of the engaging member; a driving member including a driving head and a guiding groove at two different ends, with the guiding groove receiving the first inserting member and which interconnecting the engaging member and the driving member, with the biasing member disposed between the driving member and the engaging member; a control ring receiving the driving member and selectively movable between a first position disposed at a first relative position with respect to the engaging member and in which the screwing tool becomes an impact screwdriver, and a second position disposed at a second relative position with respect to the engaging member and in which the screwing tool becomes a regular screwdriver; wherein the guiding groove is extended annularly and V-shaped and includes two terminal ends thereof defining first and second stop ends and a turning corner at a junction of two groove sections of the V-shaped guiding groove.

2. The screwing tool as claimed in claim 1 wherein the control ring moved to the first position is spaced from the engaging member with a gap, and wherein the control ring moved to the second position is in contact with the engaging member with the gap eliminated.

3. The screwing tool as claimed in claim 1 wherein the engaging member and the driving member are movably engaged with each other and that when the control ring is moved to the first position moving the engaging member axially makes the driving member rotate with respect to the engaging member and that when the control ring is moved to the second position rotating the engaging member makes the driving member rotate in synchronization.

4. The screwing tool as claimed in claim 1 wherein the control ring is rotatably moved between the first and second positions.

5. The screwing tool as claimed in claim 1 wherein the driving member includes an outer periphery thereof including at least one protrusion exposed therefrom, wherein the driving member includes the at least one protrusion disposed between the driving head and the guiding groove, wherein the control ring defines at least one locking section, with the at least one protrusion corresponding to the at least one locking section and movable to a position thereof preventing relative rotation the control ring with respect to the driving member.

6. The screwing tool as claimed in claim 5 wherein the at least one locking section includes a stop edge and first and second channels, with the first channel extended from the stop edge, with the second channel extended from the first channel, wherein the at least one protrusion is movable in the first channel to either the stop edge or the second channel, wherein the at least one protrusion is abutted against the stop edge when the control ring is moved to the first position, and wherein the at least one protrusion is received in the second channel when the control ring is moved to the second position.

7. The screwing tool as claimed in claim 6 wherein the first channel is extended annularly, and wherein the second channel is extended axially.

8. The screwing tool as claimed in claim 6 wherein the control ring includes an end thereof defining a terminal edge, wherein the second channel has two opposite ends defining first and second ends, with the first end connected to the first channel, wherein the second end of the second channel is spaced from the terminal edge at a greater distance than the stop edge.

9. The screwing tool as claimed in claim 6 wherein the driving member includes a second inserting member disposed therein, wherein the second inserting member includes an end thereof defining the at least one protrusion.

10. The screwing tool as claimed in claim 1 wherein the driving member includes first and second receptacles defined therein and extended radially, wherein the first receptacle includes a retaining device received therein, wherein the second receptacle includes a detent device received therein, wherein the control ring includes an inner periphery thereof including first and second sections, with the first and second sections having different internal diameters, wherein the retaining device is enclosed in the second section of the inner periphery of the control ring and the detent device is exposed outside and abutting against an end of the control ring respectively when the control ring is moved to the first position, and wherein the retaining and detent devices are enclosed in the first section of the inner periphery of the control ring when the control ring is moved to the second position.

11. The screwing tool as claimed in claim 10 wherein the retaining device includes a locking member and a first biasing element biasing the locking member to engage with the control ring, and wherein the detent device includes a stopping member and second biasing element biasing the stopping member to engage with the control ring.

12. The screwing tool as claimed in claim 11 wherein each of the locking and stopping members is of spherical shape.

13. The screwing tool as claimed in claim 11 wherein the first and second biasing elements are springs.

14. The screwing tool as claimed in claim 3 wherein the first inserting member is movably engaged in the guiding groove and that the driving member is rotated when the engaging member is moved axially, with the control ring moved to the first position, and wherein the first inserting member is rest on and abutted against either the first or second stop ends when the control ring is moved to the second position.

15. The screwing tool as claimed in claim 1 wherein the control ring includes an outer periphery thereof including indicia and an anti-slip pattern, with the indicia indicating directions that the control ring is adapted to be operated.

16. The screwing tool as claimed in claim 1 wherein the engaging member includes an outer periphery thereof including at least one anti-slip area and at least one hump exposed therefrom preventing a user to lose a firm grip on the engaging member.

17. The screwing tool as claimed in claim 1 wherein the engaging member includes an end thereof defining an impact surface that a hammer whacks when the screwing tool becomes the impact screwdriver.

18. The screwing tool as claimed in claim 1 wherein the engaging member includes an outer periphery thereof including a recessed section inset, a first aperture extended in the recessed section, and a flange protruded outwards, wherein the first inserting member is received in the first aperture, wherein the engaging member includes an annular member sleeved on the recessed section and restraining the first inserting member, with the flange preventing the annular member disengaged from the engaging member.

* * * * *